United States Patent [19]

Soma et al.

[11] 4,247,363

[45] Jan. 27, 1981

[54] PROCESS FOR PRODUCING STONE GROUNDWOOD PULP FROM WOOD CHIPS BY USING A STONE GRINDER

[75] Inventors: Shigeharu Soma; Tadao Onodera; Yoshio Onodera, all of Tomakomai, Japan

[73] Assignee: Oji Paper Co., Ltd., Tokyo, Japan

[21] Appl. No.: 948,416

[22] Filed: Oct. 4, 1978

[30] Foreign Application Priority Data

Oct. 17, 1977 [JP] Japan ..... 52-123599

[51] Int. Cl.[3] ..... B21B 1/14; B27L 11/08

[52] U.S. Cl. ..... 162/28; 162/56; 162/68; 162/83; 162/90; 241/28

[58] Field of Search ..... 162/28, 60, 83, 90, 162/20, 24, 27, 56; 241/28

[56] References Cited

U.S. PATENT DOCUMENTS

| | | | |
|---|---|---|---|
| 1,399,976 | 12/1921 | Manson | 241/28 |
| 1,532,946 | 4/1925 | Rabus | 241/28 |
| 2,075,023 | 3/1937 | David | 162/56 |
| 2,689,092 | 9/1954 | Clark et al. | 241/28 |
| 3,612,413 | 10/1971 | Pessy | 241/28 |
| 3,690,568 | 9/1972 | Alexander | 241/28 |

OTHER PUBLICATIONS

MacDonald et al., editor, "Pulp and Paper Manufacture, vol. I", McGraw-Hill Book Co., pp. 172–175, 1969.

Casey, "Pulp and Paper, vol. I, 2nd Edition", Interscience Publishers Inc., N.Y., 1960, pp. 319–321.

*Primary Examiner*—S. Leon Bashore
*Assistant Examiner*—Steve Alvo
*Attorney, Agent, or Firm*—Armstrong, Nikaido, Marmelstein & Kubovcik

[57] ABSTRACT

Disclosed is a process for producing stone groundwood pump from wood chips, by compressing a wood chip mass into an apparent volume corresponding to 70% or less, preferably, from 40 to 60%, of the original apparent volume of the wood chip mass and by grinding the compressed wood chip mass, under pressure, with a stone grinder. The wood chips may be treated, before the grinding step, with both or either one of steam and a treating agent, such as sodium monosulfite, sodium disulfite and sodium bicarbonate.

8 Claims, 4 Drawing Figures

PROCESS FOR PRODUCING STONE GROUNDWOOD PULP FROM WOOD CHIPS BY USING A STONE GRINDER

FIELD OF THE INVENTION

The present invention relates to a process for producing groundwood pulp. More particularly, the present invention relates to a process for producing groundwood pulp from wood chips by using a stone grinder.

BACKGROUND OF THE INVENTION

A process for producing groundwood pulp by grinding logs with a stone grinder is well known. However, this procwss is disadvantageous in the following points.

1. It is difficult to obtain logs in an amount which is sufficient for industrial use.

2. It is relatively difficult to control the quality of the resultant product.

3. A relatively large amount of labor is required to carry out the process.

Recently, the timber resources of the world are being steadily depleted and, therefore, every country which exports logs tends to restrict the amount of logs exported. Accordingly, there is little question that obtaining logs as raw material for the pulp and paper industry will become increasingly difficult in the future.

Under these circumstances, in the last few decades, a process for producing groundwood pulp from wood chips by using a refiner has been developed and become popular in the pulp and paper industry. This process is referred to as a refiner process and the resultant product is referred to as a refiner groundwood pulp, hereinafter.

In addition, a process for thermomechanically producing groundwood pulp has been developed and is becoming popular in the pulp and paper industry. This process is an improvement of the refiner process and is referred to hereinafter as a thermomechanical process, and the resultant product is referred to hereinafter as a thermomechanical pulp.

The specific power consumption necessary for producing one ton (air-dry weight) of the each of the stone groundwood pulp from logs, the refiner groundwood pulp and the thermomechanical pulp, and the properties of each of these pulps, are shown in Table 1.

TABLE 1

| Item | Pulp | | |
|---|---|---|---|
| | Stone groundwood pulp from logs | Refiner groundwood pulp | Thermomechanical pulp |
| Specific power consumption KWH/Ton A.D. | 1100 | 1800 | 2000 |
| Product | | | |
| Freeness mlCSF | 80 | 100 | 100 |
| Percentage of fiber fraction | | | |
| Remaining on 24 mesh screen | 15 | 25 | 37 |
| Passed through 150 mesh screen | 52 | 28 | 35 |
| Bulk density (g/cm$^3$) | 0.41 | 0.35 | 0.38 |
| Breaking length (km) | 2.6 | 3.2 | 3.8 |
| Tear factor | 45 | 60 | 85 |
| Scattering coefficient | 800 | 700 | 620 |

Table 1 clearly shows that the refiner groundwood pulp and the thermomechanical pulp are advantageous in having a high freeness, a large breaking length which is due to the large content of the long fibers remaining on the 24 mesh screen, and a high tear factor. However, they have the following disadvantages.

1. The specific power consumption of the refiner groundwood pulp or the thermomechanical pulp is very large, that is, about twice that of the stone groundwood pulp from logs having the same freeness as that of the refiner groundwood pulp or the thermomechanical pulp.

2. The resultant pulp from the refiner process or the thermomechanical process has a high content of the long fibers remaining on the 24 mesh screen, and a low content of the small sized fibers passed through the 150 mesh screen. Accordingly, when this type of the pulp is used for producing paper, the surface of the resultant paper has a relatively poor smoothness.

3. Due to the property of the pulp mentioned in the item 2, above, the resultant paper has a relatively low degree of opacity.

Usually, paper for newspapers is produced from a pulp composition consisting of two or more different types of pulps, including a mechanical pulp such as the refiner groundwood pulp or the thermomechanical pulp. If the pulp composition for producing the paper for newspapers contains, as the mechanical pulp component, refiner groundwood pulp or thermomechanical pulp alone, which contains relatively large amounts of long fibers and a relatively small amount of small sized fibers, the resultant paper for newspapers will have a poor opacity and a low degree of smoothness. Also, since the production of the refiner groundwood pulp or the thermomechanical pulp needs a large specific power consumption, the use of the refiner groundwood pulp or the thermomechanical pulp results in a large comsumption of energy as a whole being required for the production of paper for newspapers.

In order to offset the drawbacks of the refiner groundwood pulp and the thermomechanical pulp, it is preferable that stone groundwood pulp from logs be used together with the above-mentioned pulps. However, as mentioned hereinbefore, it is difficult to procure sufficient logs for the stone groundwood pulp from logs. Accordingly, in order to obviate all of the above-mentioned problems, it is desirable to provide a new process for producing, from wood chips, a groundwood pulp having the same quality as the stone groundwood pulp from logs at the same specific power consumption as that of the process for stone grinding the logs.

Previously, the production of the stone groundwood pulp from wood chips has had the following problems.

1. It is well-known that wood material is composed of a large number of fibers which are orientated substantially parallel to each other along the longitudinal axis of the wood material. Accordingly, in the case where a wood material is ground by a stone grinder, the contact of the wood material with the peripheral surface of the cylindrical grinding stone may be effected in any of the following three manners.

A. The direction of the orientation of the fibers in the wood material is substantially parallel to a shaft around which the stone grinder rotates. In this case, the grinding process can be carried out with an excellent efficiency and the resultant groundwood pulp has an excellent quality.

B. The direction of the orientation of the fibers in the wood material is substantially parallel to a line tangent to the peripheral surface of the grinding stone. In this case, the resultant groundwood pulp has an excellent quality, but the productivity of the grinding process is relatively poor.

C. The direction of the orientation of the fibers in the wood material is substantially parallel to the radius of the cylindrical stone. In this case, the productivity of the grinding process is good, but the quality of the resultant groundwood pulp is poor because the fibers in the wood material are broken during the grinding operation.

When logs are used as the wood material, the grinding is usually carried out in the manner described in item A, above. However, when a group of wood chips are fed to the stone grinder, the wood chips will contact the peripheral surface of the grinding stone in random, various manners, including the above-mentioned manners A, B, C and various intermediate manners between the manners A, B, C. Accordingly, it is natural that the quality of stone groundwood pulp produced from wood chips is poorer than that of stone groundwood pulp from logs.

2. In the case where the logs are ground by a stone grinder, the discharge of the resultant pulp from the grinding region while maintaining the log in the grinding region can be easily attained by providing guide plates located close to the grinding surface of the stone to form peripheral partitions surrounding the grinding region. However, in the case where small sized wood chips are fed to the stone grinder, portions of unground wood chips and incompletely ground wood chips can easily pass through the clearance between the peripheral surface of the grinding stone and the lower ends of the guide plates during the grinding operation. Naturally, in such a case, it is necessary to prevent the undesirable discharge of the unground and incompletely ground wood chips from the grinding region.

Accordingly, in order to utilize wood chips for producing stone ground wood pulp having the same quality as that of the stone groundwood pulp from logs at the same specific power consumption as that of the log grinding process, the above-mentioned problems must be obviated.

OBJECT OF THE INVENTION

An object of the present invention is to provide a process for producing groundwood pulp from wood chips, which can easily be obtained, in place of logs by using a stone grinder at a relatively low specific power consumption.

Another object of the present invention is to provide a process for producing, from wood chips, groundwood pulp having a higher content of small sized fibers than that of the usual stone groundwood, pulp from logs, by using a stone grinder.

A further object of the present invention is to provide a process for producing groundwood pulp by using a stone grinder, which pulp is capable of offsetting the disadvantages of the refiner groundwood pulp and the thermomechanical pulp, which are used in a large amount in the paper making industry, an also, capable of providing paper having an excellent quality at a low cost.

SUMMARY OF THE INVENTION

The above-mentioned objects can be attained by the process of the present invention. The process of the present invention comprises the steps of:

compressing a mass composed of numerous wood chips until the apparent volume of the compressed wood chip mass reaches a value corresponding to 70% or less of the original apparent volume of said wood chip mass, and;

grinding said compressed wood chip mass by grinding a bottom surface of said compressed wood chip mass into contact with a peripheral surface of a grinding stone of a stone grinder under a pressure while rotating said grinding stone.

DETAILED DESCRIPTION OF THE INVENTION

Figure 1:
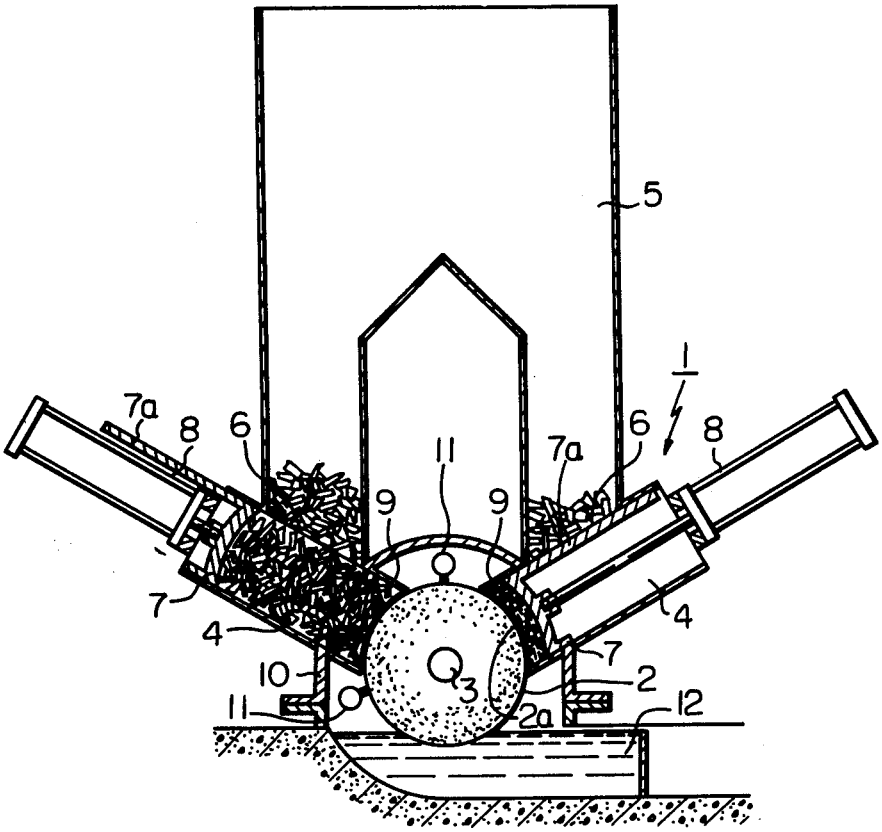
FIG. 1 is an explanatory cross-sectional view of an embodiment of the stone grinders usable for the process of the present invention.

The wood chips usable for the process of the present invention may be wood chips usable for conventional pulping processes, that is, flat wood chips each having upper and lower surfaces which are substantially parallel to the directions of the orientation of the fibers in the wood chip. The wood chips may be prepared from any kind of wood as long as the wood can be used for producing a conventional wood pulp. However, soft wood is most preferable for producing the wood chips for the process of the present invention.

The stone grinder usable for the process of the present invention is not limited to a special type of stone grinder. That is, all stone grinders can be utilized for the process of the present invention as long as the grinder can be slightly modified so as to make it suitable for the process of the present invention. That is, the modified stone grinder usable for the process of the present invention is provided with a pocket for feeding the wood chip mass to the grinding surface of the grinding stone, a hopper for supplying the wood chips into the pocket, means for compressing the wood chip mass in the pocket and pressing the compressed wood chip mass onto the grinding surface of the stone, and guide plates for preventing the undesirable discharge of unground and incompletely ground wood chips from the grinding region. Each of the above-mentioned pocket, hopper, compressing means and guide plates is limited to neither a special size nor a special shape. The construction and function of the stone grinder will be illustrated in detail hereinafter.

In the process of the present invention, the wood chip mass to be ground is compressed until the apparent volume of the compressed wood chip mass reaches a volume corresponding to 70% or less, preferably, from 40 to 60%, of the original apparent volume of the wood chip mass. The original apparent volume of the wood chip mass refers to an apparent volume of the wood chips naturally formed into a mass under natural gravitation.

For example, when numerous soft wood chips were formed into a mass under natural gravitation and, then, compressed until the apparent volume of the compressed wood chip mass reached a value corresponding to about 50% of the original apparent volume of the wood chip mass, it was observed that the wood chips in the mass moved so that the flat surfaces of the wood chips became substantially parallel to each other during the compressing operation. With respect to each wood chip, an angle between the flat surface of the wood chip in the compressed mass and the bottom surface of the compressed mass, to which bottom the compression was directed, was determined. It was found that the content of the wood chips which had an above-mentioned angle of 10 degrees or less was about 85% based on the entire number of the wood chips in the compressed mass, and; that another content of the wood chips which had an above-mentioned angle of 45 degrees or more was merely about 5% based on the entire number of the wood chips in the compressed mass. That is, during the compressing operation in the process of the present invention, the wood chips which are arranged at random in the mass in the initial stage of the compressing operation, move so that the flat surfaces of the wood chips become substantially parallel to each other. As a result of the above-mentioned movement, a compressed mass is obtained in which the fibers in most of the wood chips are orientated substantially parallel to the bottom surface of the compressed mass. Before the present invention, it was never expected that a simple compression operation results in the above-mentioned behaviour of the wood chips in the mass.

When the bottom surface of the compressed wood chip mass having the above-mentioned constitution is brought into contact with the grinding peripheral surface of the grinding stone under a pressure, the direction of the orientation of the fibers in most of the wood chips in the compressed mass is substantially parallel to either the shaft of the grinding stone around which the stone rotates, or a line tangent to the peripheral grinding surface of the grinding stone. Accordingly, the quality of the resultant groundwood chip is excellent and the grinding process can be carried out with high productivity. Also the wood chips in the compressed mass are pressed to each other and, therefore, restricted in free movement in relation to each other. Accordingly, it is difficult for separation of unground and incompletely groundwood chips from the compressed mass to occur. The undesirable discharge of the wood chip from the grinding region can be easily prevented by surrounding the grinding region by guide plates each having a proper shape and located in a proper position.

In the process of the present invention, the operation for compressing the wood chip mass may be carried out in a compression chamber located between a hopper for holding wood chips and a grinding stone, and then, the bottom surface of the compressed mass may be immediately brought into contact with the grinding surface of the stone under pressure. Otherwise, the compressed mass prepared in the compression chamber may be conveyed from the compression chamber into a grinding chamber located between the compression chamber and the grinding stone and, then, brought under a pressure into contact with the grinding surface of the stone.

In the process of the present invention, it is preferable that the compressing operation on the wood chip mass be carried out under a pressure of from 1.5 to 10 $kg/cm^2$. Also, it is preferable that in the grinding operation, the compressed wood chip mass be pressed onto the grinding surface under a pressure of from 1.5 to 5 $kg/cm^2$. Furthermore, it is preferable that the grinding stone be revolved at a peripheral surface speed of from 15 to 30 m/second.

A preferable embodiment of the stone grinder usable for the process of the present invention will now be illustrated.

Referring to FIG. 1, in a stone grinder 1, a cylindrical grinding stone 2 can revolve around a horizontal shaft 3 of the stone 2. Two pockets 4 are arranged so that the bottom of each pocket 4 faces the peripheral grinding surface 2*a* of the grinding stone 2. Each pocket 4 has an opening 6 through which the pocket 4 is connected to a hopper 5 for holding the wood chips. A compressing plate 7 is located in upper part of the pocket 4 and is connected to a piston 8. The compressing plate 7 can reciprocally move along the pocket. The pocket 4 is also provided with a guide plate 9 which is located in the lower part of the pocket 4 in such a manner that a proper clearance is formed between the lower end of the guide plate 9 and the peripheral grinding surface 2*a*. It is preferable that the width of the clearance be in a range of from 1 to 2 mm and be adjustable. The grinding stone 2 is contained in a grinding chamber 10. The grinding chamber 10 is provided with means 11 for showering water toward the peripheral grinding surface 2*a*. The compressing plate 7 is provided with a shutting plate 7*a* for closing the opening 6 of the pocket 4. When the compressing plate 7 is raised up so as to open the opening 6, wood chips in the hopper 6 are charged into the pocket 4 through the opening 6. Next, the piston 8 is actuated so as to push down the compressing plate 7. The wood chips in the pocket 4 are compressed by the compressing plate and form a compressed mass having an apparent volume corresponding to 70% or less of the initial apparent volume of the wood chip mass. The initial apparent volume of the wood chip mass is substantially the same as the volume of the inside space of the pocket 4 when the wood chips are fed thereinto. The compressed wood chip mass is pressed onto the grinding peripheral surface 2*a* of the grinding stone 2 which is rotating. The bottom of the compressed wood chip mass is brought into contact with the peripheral grinding surface 2*a* and ground thereby. The resultant groundwood pulp is discharged through the narrow clearance between the peripheral grinding surface 2*a* and the guide plate 9 and flows downwardly by action of water ejected from the showering means 11. The groundwood pulp is received in a pit 12.

The stone grinder 1 shown in FIG. 1 has a pair of pockets 4. The pockets 4 can be used either alternately or simultaneously. The stone grinder may be provided with only one pocket or with three or more pockets.

In the stone grinder of FIG. 1, the compressing operation and the operation for pressing the compressed wood chip mass onto the peripheral grinding surface are carried out by using a compressing plate and a piston. However, the compressing operation and the pressing operation can be carried out by using another method, for example, a method for reciprocally moving the compressing plate by a screw. Also, a chain grinder in which the wood chips are compressed by means of a rotatable chain having a log may be used.

It was found that, in the groundwood pulp resulting from the process of the present invention, the content of a fraction of relatively long fibers which remain on a 24 mesh screen is a little smaller than that of the conventional groundwood, pulp from logs, and the content of the fraction of relatively small sized fibers which passed through a 150 mesh screen is considerably larger than that of the conventional groundwood, pulp from logs. This feature will be illustrated in Table 2, of Example 1, hereinbelow. Therefore, the groundwood pulp of the present invention is very useful as a component pulp to be blended into the refiner groundwood pulp and the thermomechanical pulp which have a relatively large content of the long fibers and a relatively small content of the small sized fibers. This blended pulp is useful for producing paper for newspapers, mechanical pulp-containing book paper, rotogravure paper and other papers which are required to have relatively high degrees of opacity and smoothness.

However, when the content of the fraction of the small sized fibers in the groundwood pulp is too large, the resultant paper has a relatively poor mechanical strength. In this case, it is desirable to decrease the content of the small sized fibers in the pulp to the level of that of stone groundwood, pulp from logs. For this purpose, it is preferable that the wood chip be treated with both or either one of steam and a treating agent. This treatment is effective for increasing the content of the long fibers in the pulp and also for increasing the mechanical strength of a pulp sheet consisting of the pulp.

The steam treatment may be applied to the wood chips at a stage either before or during the compressing operation, or during the grinding operation. The temperature of the steam for the treatment is not limited to a special range of temperature. Usually, the steam treatment is preferably carried out at a temperature of from 100° to 130° C. The steam treatment can cause the wood chips to be softened and, therefore, the fibers to be easily separated from each other without breakage thereof. Also, the steam treatment causes the plasticity of the wood chip to be increased. Therefore, the wood chips can easily move so as to increase the degree of orientation of the fibers in the wood chip mass. This feature results in an increase in the content of the long fibers in the resultant pulp.

The treatment of the wood chips may be carried out by using a treating agent in place of steam. The treating agent used is one which is effective for softening the wood chips and may be selected from the group consisting of sodium bisulfite, sodium monosulfite, sodium bicarbonate and mixtures of two or more of the above-mentioned compounds. The treating agent is dissolved to provide a treating aqueous solution thereof. The treating solution is applied to the wood chips in an optional stage of either before or during the grinding operation. It is preferable that the treating agent be applied in an amount of from 0.5 to 20%, based on the dry weight of the wood chips. The treatment of the wood chips with the treating agent may be carried out concurrently with the steam treatment.

The features and advantages of the present invention will be further illustrated by the following examples, which are presented for the purpose of illustration only and should not be interpreted as limiting the scope of the present invention.

EXAMPLES 1 to 3

In Example 1, wood chips made from Japanese spruce and fir wood were fed into a stone grinder of the type illustrated in FIG. 1. The stone grinder was operated under the following conditions.

| | |
|---|---|
| Power of motor | 250 KW |
| Dimension of grinding stone | |
| diameter | 1000 mm |
| length | 420 mm |
| Grid size | #60 100% |
| Hardness | 0 |
| Peripheral surface speed | 25m/second |
| Dimensions of bottom surface of compressed wood chip mass | |
| Length | 350 mm |
| Width | 280 mm |
| Travel length of compressing plate | 700 mm |
| Compressing pressure | 2 kg/cm$^2$ |
| Pressing pressure | 5 kg/cm$^2$ |

The resultant groundwood pulp was subjected to a freeness measurement, and screening. The resultant groundwood pulp was formed into a pulp sheet having a weight of 60 g/m$^2$. The pulp sheet was subjected to measurements of bulk density, breaking length, tear factor and scattering coefficient. The results are shown in Table 2.

In Example 2, the same procedures as those described in Example 1 were carried out, except that wood chips which had been made of soft wood imported from the west coast of the United States were used. The results are shown in Table 2.

In Example 3, procedures identical to those described in Example 2 were carried out, except that other wood chips which had been made from soft wood imported from the west coast of the United States, were used. The results are shown in Table 2.

In Comparison Example 1, procedures identical to those described in Example 1 were carried out, except that the groundwood plup was produced from Japanese spruce and fir logs by using a chain grinder. The results are also shown in Table 2.

TABLE 2

| Example No. | 1 | 2 | 3 | Comparison Example 1 |
|---|---|---|---|---|
| Specific power consumption KWH/T A.D. | 800 | 940 | 1210 | 1,120 |
| Pulp | | | | |
| Freeness (ml CSF) | 26 | 23 | 30 | 79 |
| Percentage of fiber fraction | | | | |
| Remaining on 24 mesh screen | 5.0 | 3.2 | 0.6 | 15.2 |
| Remaining on 42 mesh screen | 7.6 | 6.1 | 4.7 | 8.5 |
| Remaining on 80 mesh screen | 7.1 | 6.5 | 5.1 | 7.2 |
| Remaining on 150 mesh screen | 16.5 | 16.7 | 12.4 | 17.4 |
| Passed through 150 mesh screen | 63.8 | 67.5 | 77.2 | 51.7 |
| Pulp sheet | | | | |
| Bulk density (g/cm$^3$) | 0.49 | 0.48 | 0.54 | 0.41 |
| Breaking length (km) | 2.78 | 2.66 | 3.35 | 3.00 |
| Tear factor | 32 | 31 | 25 | 45 |
| Scattering coefficient | 830 | 780 | 762 | 805 |

EXAMPLE 4

In order to produce a stone groundwood pulp, the same procedures as those mentioned in Example 3 were carried out. Three types of pulp mixtures, A, B and C were produced with the following compositions.

| | Composition (%) | | |
|---|---|---|---|
| Pulp mixture | A | B | C |
| Sulphite pulp | 20 | 20 | 20 |
| Hard wood chemiground wood pulp | 35 | 35 | 35 |
| Refiner groundwood pulp | 45 | 40 | 35 |
| Stone groundwood pulp of | | | |

-continued

| | Composition (%) | | |
|---|---|---|---|
| Pulp mixture | A | B | C |
| the present invention | 0 | 5 | 10 |

Figure 2:
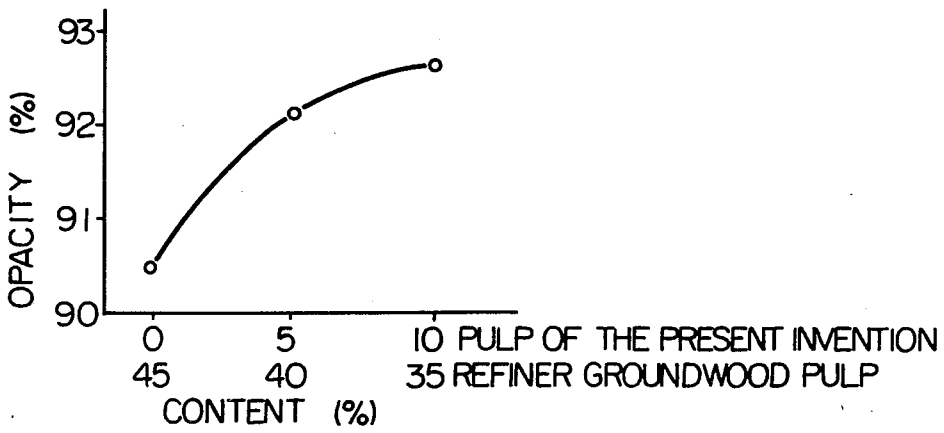
FIG. 2 is a graph showing a relationship between the proportions of two different kinds of pulp in various pulp compositions and the degree of opacity of papers produced from the pulp compositions.
Figure 3:
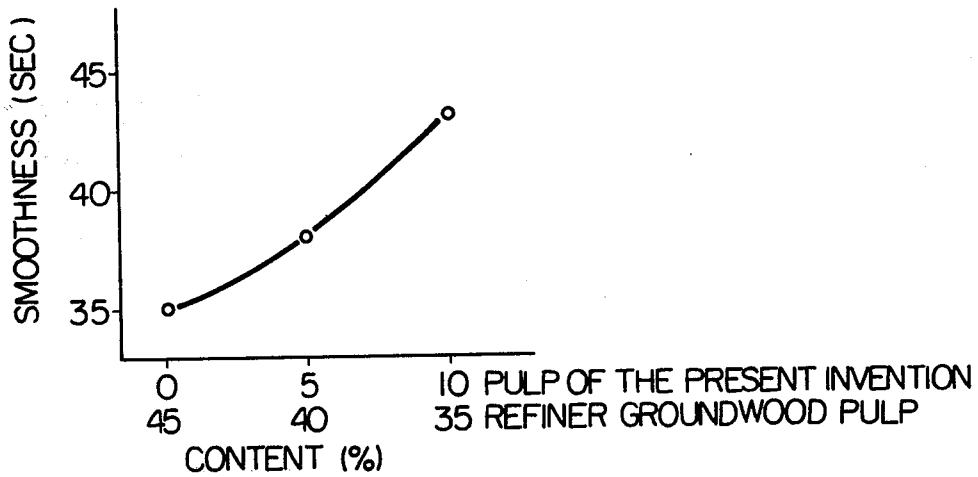
FIG. 3 is a graph showing a relationship between the above-mentioned proportions of the pulp and the smoothness of the resultant papers.
Figure 4:
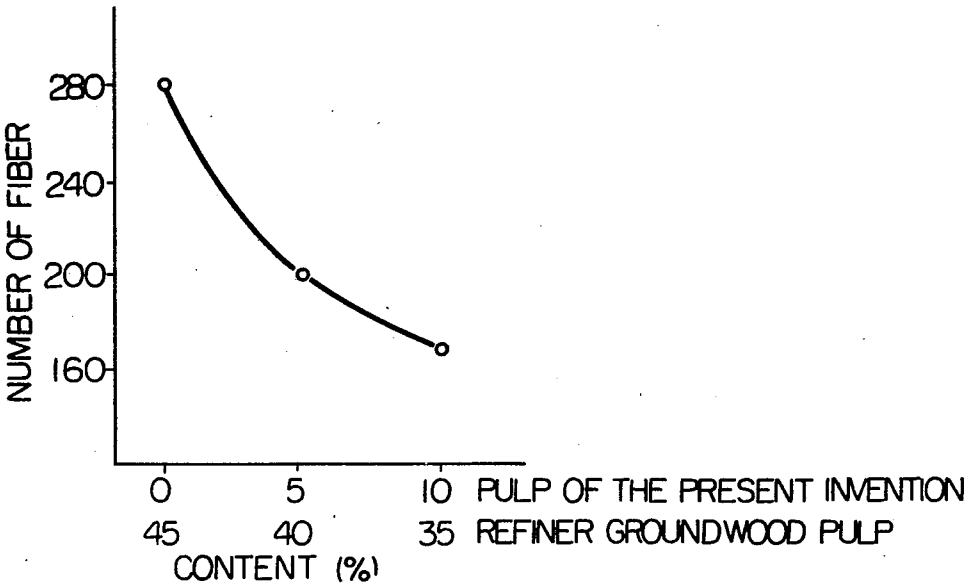
FIG. 4 is a graph showing a relationship between the above-mentioned proportions of the pulp and the number of fibers which are separated from the resultant papers during a printing process applied to the papers.

Each of pulp mixtures A, B, C was suspended in water to form a pulp slurry, and a hand made paper sheet was produced from the pulp slurry in accordance with a conventional paper-making process. The resultant sheet was calendered under a pressure of 20 kg/cm by using a table type calender. With respect to each sheet, the degree of opacity and the degree of smoothness were determined. Also, each sheet was subjected to a printing operation by using a test printing machine having a smooth surfaced printing plate. During the printing process, the number of fibers separated from the sheet and adhered to the printing plate was measured. The results are shown in FIGS. 2 to 4. FIGS. 2 to 4 show that the stone groundwood pulp produced in accordance with the process of the present invention is effective for increasing the degrees of opacity and smoothness of the sheet, and also, for decreasing the number of the fibers separated from the sheet during a printing process.

EXAMPLES 5 to 8

In Example 5, the same procedures as those described in Example 1 were carried out, except that soft wood chips which had been imported from the United States were used. The grinding operation was carried out without treating the wood chips with steam or a treating agent.

In Example 6, the same procedures as those mentioned in Example 5 were carried out, except that the wood chips were treated with steam having a temperature of 105° C. under an ambient pressure for 5 minutes, by blowing the steam into the hopper before the grinding operation.

In Example 7, the same procedures as those described in Example 5 were carried out, except that before the grinding operation, the wood chips were immersed in an aqueous solution of 75 g/l of sodium monosulfite, at a temperature of 30° C., for 60 minutes, and then, charged into the hopper. The wood chips absorbed the sodium monosulfite in an amount of 10.7% based on the dry weight of the wood chips.

In Example 8, the same procedures as those described in Example 7 were carried out, except that the wood chips treated with the sodium monosulfite solution were additionally treated in the hopper, in the same manner as mentioned in Example 6.

The results are shown in Table 3.

TABLE 3

| Example No. | 5 | 6 | 7 | 8 |
|---|---|---|---|---|
| Treatment | None | Steam | $Na_2SO_3$ | $Na_2SO_3$ and Steam |
| Specific power consumption (KWH/T A.D.) | 1150 | 1210 | 1155 | 1000 |
| Pulp | | | | |
| Freeness (ml. CSF) | 38 | 45 | 50 | 65 |
| Percentage of fiber fraction | | | | |
| Remaining on 24 mesh screen | 3.8 | 5.0 | 6.8 | 8.0 |
| Remaining on 42 mesh screen | 7.3 | 8.2 | 9.5 | 9.1 |
| Remaining on 80 mesh screen | 8.1 | 9.1 | 10.0 | 11.7 |
| Remaining on 150 mesh screen | 15.3 | 16.3 | 17.4 | 17.0 |
| Passed through 150 mesh screen | 65.5 | 61.4 | 56.3 | 54.2 |
| Pulp sheet | | | | |
| Breaking length (Km) | 3.15 | 3.20 | 3.55 | 3.68 |
| Tear factor | 32 | 34 | 43 | 45 |
| Scattering coefficient | 830 | 760 | 670 | 640 |

Table 3 clearly shows that the treatment of the wood chips with both or either one of steam and the treating agent, is effective for increasing the freeness of the resultant pulp, the content of long fibers in the pulp, and the breaking length and the tear factor of the pulp sheet, and; also, for decreasing the content of small sized fibers in the pulp and the scattering coefficient of the pulp sheet.

From a comparison of Table 2 with Table 3, it is evident that, generally, the properties of the stone ground pulp of Example 8 are closer to those of the pulp of Comparison Example 1 than those of the pulps of Example 4.

What we claim is:

1. A process for producing stone groundwood pulp from wood chips by using a stone grinder of the type having at least one pocket for containing wood chips, which process comprises the steps of:

placing a mass of wood chips into said at least one pocket;

compressing said mass of wood chips within said at least one pocket under a pressure of from 1.5 to 10 kg/cm$^2$ until the apparent volume of the compressed wood chip mass reaches a value corresponding to 70% or less of the original apparent volume of the wood chip mass, and the fibers of the wood chips become substantially parallel to the bottom surface of the compressed mass, and;

grinding said compressed wood chip mass by bringing a bottom surface of said compressed wood chip mass into contact with a peripheral grinding surface of a grinding stone of a stone grinder, wherein the fibers of the compressed wood chip mass is substantially parallel to either the shaft of the grinding stone around which the stone rotates, or a line targent to the peripheral grinding surface of the grinding stone, and by maintaining the pressure applied to said compressed wood chip mass at a level of from 1.5 to 5 kg/cm$^2$, while rotating said grinding stone.

2. A process as claimed in claim 1, wherein said wood chips are treated with steam, before the grinding operation.

3. A process as claimed in claim 2, wherein said steam has a temperature of from 100° to 130° C.

4. A process as claimed in claim 1, wherein the compressed wood chip mass has an apparent volume corresponding to from 40 to 60% of the original apparent volume of the wood chip mass.

5. A process as in claim 1 wherein said wood chips are treated with a treating agent before the grinding operation.

6. A process as in claim 1 wherein said wood chips are treated with steam and a treating agent before the grinding operation.

7. A process as claimed in claims 5 or 6 wherein said treating agent is selected from the group consisting of sodium bisulfite, sodium monosulfite, sodium bicarbonate and mixtures of two or more of the above-mentioned compounds.

8. A process as claimed in claims 5 or 6 wherein said treating agent is absorbed in an amount of from 0.5 to 20% based on the dry weight of the wood chips.

* * * * *